US006463926B1

(12) United States Patent
Flick et al.

(10) Patent No.: US 6,463,926 B1
(45) Date of Patent: Oct. 15, 2002

(54) DIRECT VENT FIREPLACE WITH BAFFLED, DIRECTIONAL EXHAUST AND VENT AIR COLUMN

(75) Inventors: Christopher L. Flick, Fort Wayne; Corbit Beasey, Roanoke, both of IN (US); David M. Christensen, O'Fallon, IL (US); Robert B. Zahm, Huntington, IN (US)

(73) Assignee: American Hearth Systems, Inc., Fort Wayne, IN (US)

( * ) Notice: Subject to any disclaimer, the term of this patent is extended or adjusted under 35 U.S.C. 154(b) by 0 days.

(21) Appl. No.: 09/590,893

(22) Filed: Jun. 9, 2000

(51) Int. Cl.[7] ..... F24C 3/00; F23J 11/00

(52) U.S. Cl. ..... 126/512; 126/85 B; 126/307 R

(58) Field of Search ..... 126/512, 500, 126/85 B, 77, 515, 528, 529, 307 R, 312

(56) References Cited

U.S. PATENT DOCUMENTS

| | | | | |
|---|---|---|---|---|
| 353,066 | A | 11/1886 | Jackson | 126/531 |
| 2,225,203 | A | 12/1940 | Barnes | 126/93 |
| 2,582,066 | A | 1/1952 | Resek | 126/110 B |
| 2,998,764 | A | 9/1961 | Bedell et al. | 126/85 B |
| 3,056,397 | A | 10/1962 | Little | 126/85 B |
| 3,168,088 | A | 2/1965 | Martin et al. | 126/77 |
| 3,171,402 | A | 3/1965 | Carlson | 126/116 R |
| 3,395,693 | A | 8/1968 | Cowan | 126/92 R |
| 3,435,816 | A | 4/1969 | Werth | 126/85 B |
| 3,614,948 | A | 10/1971 | Jackson et al. | 126/85 B |
| 3,628,521 | A | 12/1971 | Hodges | 126/85 B |
| 3,741,194 | A | 6/1973 | Herron | 126/85 B |
| 4,026,263 | A | 5/1977 | Boyd | 126/502 |
| 4,112,913 | A | 9/1978 | Shimek et al. | 126/519 |
| 4,135,488 | A | 1/1979 | Wells | 126/518 |
| 4,141,336 | A | 2/1979 | Fitch | 126/502 |
| 4,221,207 | A | 9/1980 | Syme | 126/77 |
| 4,279,238 | A | 7/1981 | Syme | 126/77 |
| 4,285,327 | A | 8/1981 | Buckner et al. | 126/521 |
| 4,349,009 | A | 9/1982 | Patterson et al. | 126/518 |
| 4,487,195 | A | 12/1984 | Syme et al. | 126/77 |
| 4,519,376 | A | 5/1985 | Schoeff et al. | 126/531 |
| 4,553,528 | A | 11/1985 | Wells | 126/518 |
| 4,574,773 | A | 3/1986 | Moughamian | 126/531 |
| 4,683,868 | A | 8/1987 | Ferguson et al. | 126/193 |
| 4,793,322 | A | 12/1988 | Shimek et al. | 126/512 |
| 4,852,548 | A | 8/1989 | Shimek et al. | 126/518 |
| 4,886,047 | A | 12/1989 | Bonin | 126/552 |
| 4,909,227 | A | 3/1990 | Rieger | 126/528 |
| 5,016,609 | A | 5/1991 | Shimek et al. | 126/85 B |
| 5,076,254 | A | 12/1991 | Shimek et al. | 126/512 |
| 5,092,313 | A | 3/1992 | Blackburn et al. | 126/512 |
| 5,267,552 | A | 12/1993 | Squires et al. | 126/512 |
| 5,307,801 | A | 5/1994 | Schroeter et al. | 126/512 |
| 5,320,086 | A | 6/1994 | Beal et al. | 126/512 |
| 5,452,708 | A | 9/1995 | Shimek et al. | 126/512 |
| 5,471,973 | A | * 12/1995 | Wilhoite | 126/512 |
| 5,647,342 | A | * 7/1997 | Jamieson et al. | 126/512 |
| 5,947,113 | A | 9/1999 | Beal et al. | 126/512 |
| 5,996,575 | A | * 12/1999 | Shimek et al. | 126/512 |
| 6,138,667 | A | * 10/2000 | Cakebread | 126/512 |

FOREIGN PATENT DOCUMENTS

| | | |
|---|---|---|
| EP | 0303559 | 2/1989 |
| GB | 847141 | 9/1960 |

* cited by examiner

*Primary Examiner*—Henry Bennett
*Assistant Examiner*—Josiah C. Cocks
(74) *Attorney, Agent, or Firm*—Thompson Coburn LLP

(57) ABSTRACT

A direct vent gas fireplace has an angled flue pipe that can be directed horizontally out of the back of the fireplace or vertically out of the top of the fireplace, a baffle that conceals an exhaust opening in the back of the fireplace heat chamber from view while minimizing shielding of the firebox panels surrounding the fireplace heat chamber, and an air column that directly channels venting air from the flue pipe downwardly across the back panel of the firebox to an air inlet adjacent to the bottom of the firebox.

10 Claims, 6 Drawing Sheets

DIRECT VENT FIREPLACE WITH BAFFLED, DIRECTIONAL EXHAUST AND VENT AIR COLUMN

BACKGROUND OF THE INVENTION (1) Field of the Invention

The present invention pertains to a direct vent gas fireplace that combines in a self-contained supporting outer shell beneficial features such as a directional flue pipe, a concealed exhaust opening in the fireplace firebox and a supply of vent air adjacent to the bottom of the fireplace firebox without significantly detracting from the heat exchange capabilities of the fireplace.

(2) Description of Related Art

Direct vent gas fireplaces typically include a firebox surrounding a heat chamber of the fireplace, where the firebox itself is surrounded by an outer shell. The firebox is typically constructed of left and right metal panels, top and bottom metal panels and a back panel that are connected together in a box-like configuration. The front of the firebox is left open providing access into the heat chamber of the firebox. The heat chamber contains a grate supporting a gas burner assembly which is usually concealed by gas logs. An exhaust opening is provided through the back panel of the firebox toward the top of the heat chamber to exhaust combustion fumes from the heat chamber.

The panels of the firebox are usually supported by metal walls of the surrounding outer shell of the fireplace. The outer shell is typically constructed of left and right side walls and a back wall that are spaced outwardly from the side panels and back panel of the firebox, together with opposite top and bottom walls that are spaced from the top and bottom panels of the firebox. Apart from the front access opening of the firebox, the firebox is usually completely enclosed by the outer shell walls and is supported in the outer shell with there being a void or spacing between the panels of the firebox and the walls of the outer shell. The spacing functions as a heat exchange volume surrounding the firebox in the outer shell. Vent panels are usually provided on the fireplace above and below the access opening to the firebox. An electric blower is positioned in the heat exchange volume where it will draw in ambient room air through the bottom vent of the fireplace and force a flow of air through the heat exchange volume and around the firebox and finally out through the top vent panel of the fireplace.

As air is cycled around the firebox panels by the blower, the heat of combustion in the heat chamber of the firebox is transferred through the firebox panels to the air cycled through the heat exchange volume. In this manner, the ability of the fireplace to heat the ambient air of the room in which the fireplace is positioned is optimized. Understandably, by increasing the interior surface area of the firebox panels that are directly subjected to the heat of gas combustion in the firebox heat chamber and by increasing the exterior surface area of the firebox panels that transfer the heat of combustion to the ambient room air cycled around the firebox, the ability of the fireplace to heat ambient room air is enhanced.

Over the years several structural features have been added to the typical gas fireplace to improve their combustion and versatility. For example, direct vent gas fireplaces have been developed that provide a supply of venting air from outside the building containing the fireplace directly to the firebox heat chamber. Direct vented air is typically more rich with oxygen than the ambient air of the room in which the fireplace is positioned and therefore enhances the combustion of the gas fireplace. The direct vented air of some fireplaces is provided through an air pipe that is concentric with and surrounds an exhaust pipe that is exhausting combustion fumes from the fireplace heat chamber to the building exterior. However, in some prior art direct vent gas fireplaces a system of conduits channels the vent air through the heat exchange volume between the firebox and the outer shell of the fireplace to inlet ports that supply the vent air to the heat chamber of the fireplace. The presence of the vent air conduits in the heat exchange volume of the fireplace obstructs the flow of ambient room air through the heat exchange volume and thereby detracts from the exchange of heat from the firebox panels to the flow of air cycled through the heat exchange volume by the fireplace blower.

Gas fireplaces have also been developed with an angled flue pipe that not only could be directed upwardly from the heat chamber of the fireplace as in conventional fireplaces, but could also be directed horizontally from the heat chamber to exhaust combustion fumes from the heat chamber out through a side wall of the building containing the fireplace. However, the angled flue pipe connected to the fireplace outer shell required extra available room outside the fireplace outer shell to accommodate the angled flue pipe. This, at times, would require that the fireplace be moved out from the wall of the room containing the fireplace thereby decreasing the rooms floor space, or required a larger enclosure of the fireplace flue outside the building containing the fireplace to accommodate the angled flue pipe, thus increasing the costs involved in installing the fireplace.

In addition, connecting an angled flue pipe to a fireplace to communicate the flue pipe with the heat chamber of the fireplace firebox would often require the addition of an angled firebox panel extending upwardly from the top edge of the back panel to the rear edge of the top panel of the firebox. The exhaust opening communicating with the angled flue pipe would be provided in the angled panel. However, the angled panel would extend downwardly from the top panel of the firebox and would usually be visible through the access opening of the firebox. Thus, the exhaust opening of the firebox would be viewable from the room containing the fireplace, detracting from the aesthetic appearance of the fireplace. A system of horizontal and vertical baffle plates were employed in the firebox heat chamber to conceal the exhaust opening. The baffles were connected between the side panels and the back panel of the firebox and between the side panel and the top panel of the firebox, concealing the exhaust opening while providing a flow path for combustion fumes from the heat chamber to the exhaust opening. However, the system of baffles had the detrimental effect of shielding portions of the firebox panel interior surfaces from the heat of combustion and thereby detracted from the ability of the fireplace to heat ambient room air circulated around the firebox.

What is needed to overcome the disadvantages associated with prior art direct vent gas fireplaces is a direct vent gas fireplace constructed with the beneficial features of an angled directional flue pipe that does not require additional space outside the fireplace outer shell to accommodate and support the angled flue pipe, an exhaust opening baffle that covers the exhaust opening from view but does not shield the firebox panels from the combustion heat in the heat chamber, and a system for directing vent air to the heat chamber without significantly obstructing the flow of ambient room air through the heat exchange volume of the fireplace.

SUMMARY OF THE INVENTION

The basic construction of the direct vent gas fireplace of the invention is similar to that of prior art gas fireplaces in that it includes a firebox supported in and surrounded by an outer shell and an angled flue pipe that enables the outlet end of the flue pipe to be directed either vertically or horizontally. However, the gas fireplace of the invention includes novel structural features that improve its efficiency in transferring heat of combustion to ambient room air cycled through the fireplace and also provide the fireplace with a self-contained, supporting structure for the angled flue pipe that contains a majority of the flue pipe within the outer shell and therefore can be installed in a home or building without having to accommodate and support an angled flue pipe projecting from the fireplace.

The fireplace is basically constructed from formed sheet metal panels that are connected together by sheet metal screws, rivets, spot welds, crimping or other equivalent means of connection. The firebox is comprised of a plurality of panels that surround a heat chamber of the firebox that is accessible through a front opening of the fireplace. The heat chamber contains the gas burner as well as the decorative grate and the gas logs that cover the gas burner. Air vent openings are provided through a back panel of the firebox and a combustion fume exhaust opening is provided through an angled back panel.

The outer shell encloses the firebox and supports the firebox in the outer shell in a suspended manner that creates a heat exchange volume between the exterior of the firebox and the interior of the outer shell. The outer shell includes a plurality of walls that surround the firebox. Top and bottom vent panels extend between the outer shell side walls above and below the access opening of the firebox. The outer shell also includes an electrically operated blower that is selectively activated to draw in ambient room air through the lower vent panel and cycle the air around the firebox in the heat exchange volume of the outer shell before forcing heated air out through the upper vent panel. The back of a top wall of the outer shell and the top of a rear wall of the outer shell are joined together at a right angle along a top, rear edge of the outer shell. The top wall has a rectangular opening at its back edge and the rear wall also has a rectangular opening at its top edge. The two rectangular openings intersect each other and provide sufficient clearance for the flue pipe of the fireplace whether the flue pipe extends vertically or horizontally.

The flue pipe is an angled flue pipe constructed similar to those of the prior art. The flue pipe includes a center exhaust pipe and a concentric air pipe that surrounds the exhaust pipe. Both the exhaust pipe and the air pipe have the same angled configuration. The exhaust pipe is secured around and communicates with the exhaust opening in the angled back panel of the firebox. The flue pipe can be connected to the firebox in two positions of the flue pipe relative to the firebox. In one position of the angled flue pipe, the exhaust pipe and air pipe extend vertically through the rectangular opening in the outer shell top wall. In the second position of the flue pipe, both the exhaust pipe and air pipe extend horizontally through the rectangular opening in the outer shell rear wall. In both positions of the flue pipe it is primarily contained inside the outer shell.

The novel construction of the gas fireplace of the invention includes a flue pipe plate that closes the rectangular openings in the outer shell top wall and outer shell rear wall, and also provides support to the flue pipe in both positions of the flue pipe relative to the firebox. The flue pipe plate is basically comprised of two rectangular sections that are bent at a right angle relative to each other. Only one of the two sections of the flue pipe plate has an opening and the opening is dimensioned to receive the flue pipe in a snug fit. The pipe plate can be attached to the outer shell in two positions of the plate relative to the shell. In a first position of the pipe plate the section with the opening is attached to the outer shell top wall and the other section of the pipe plate closes the opening in the outer shell rear wall. The pipe plate is attached to the outer shell in this position when the angled flue pipe attached to the firebox projects vertically from the outer shell through the pipe plate opening. In the second position of the pipe plate the section of the plate with the opening is attached to the outer shell rear wall and the other section of the plate closes the opening in the outer shell top wall. This positioning of the pipe plate is used when the angled flue pipe is attached to the firebox with the flue pipe projecting horizontally from the outer shell. In either position of the pipe plate, the pipe plate opening surrounds the end of the angled flue pipe that projects from the outer shell and provides support to the flue pipe. In addition, the outer shell together with the flue pipe plate contain the angled portion of the flue pipe within the outer shell.

The novel construction of the fireplace also includes a baffle in the fireplace heat chamber that conceals the exhaust opening from view without appreciably shielding the interior of the firebox from the heat of combustion generated in the heat chamber. The baffle has a simple and inexpensive one-piece construction. The baffle is generally planar with a rectangular perimeter edge and a pair of spacer arms that project at angles from opposite sides of the baffle. The arms are connected to the angled pack panel of the firebox on opposite sides of the exhaust opening. The baffle is dimensioned just large enough so that it will conceal the exhaust opening from view through the access opening of the firebox. In this manner, the baffle aesthetically conceals the exhaust opening from view, but does not appreciably shield the interior surface of the firebox panels from the heat of combustion in the heat chamber as do many prior art baffles that are connected to the firebox panels and extend completely across the width of the firebox.

The gas fireplace of the invention is also provided with a vent air column that communicates with the vent air pipe of the flue pipe and provides a direct path from the vent air pipe to the air vent openings of the firebox. The air column is centered behind the firebox and extends downwardly from the air pipe that surrounds the exhaust pipe of the fireplace directly to a pair of air vent inlets that pass through the firebox back panel adjacent the bottom of the firebox. By constructing the air column in this manner, the air column provides a direct path of vent air passing through the air pipe of the flue to the vent air inlets of the firebox which minimizes any transfer of heat from ambient room air circulated through the heat exchange volume to the cooler vent air passing through the air column and also minimizes any obstruction to the flow of ambient room air through the heat exchange volume around to the firebox.

The direct vent gas fireplace of the invention constructed as described above provides the benefits of positioning the angled flue pipe of the fireplace within the fireplace outer shell thereby eliminating the need for additional structure outside the fireplace to accommodate and support the angled flue pipe, concealing the exhaust opening in the firebox from view through the firebox access opening without appreciably shielding the interior surfaces of the firebox from the heat of combustion in the firebox heat chamber, and providing vent air to the heat chamber of the firebox without appreciably obstructing or cooling the flow of ambient air through the heat exchange volume of the fireplace.

DESCRIPTION OF THE DRAWINGS

Further novel features of the invention are set forth in the following detailed description of the preferred embodiment of the invention and in the drawing figures wherein.

DETAILED DESCRIPTION OF THE PREFERRED EMBODIMENT

Figure 1:
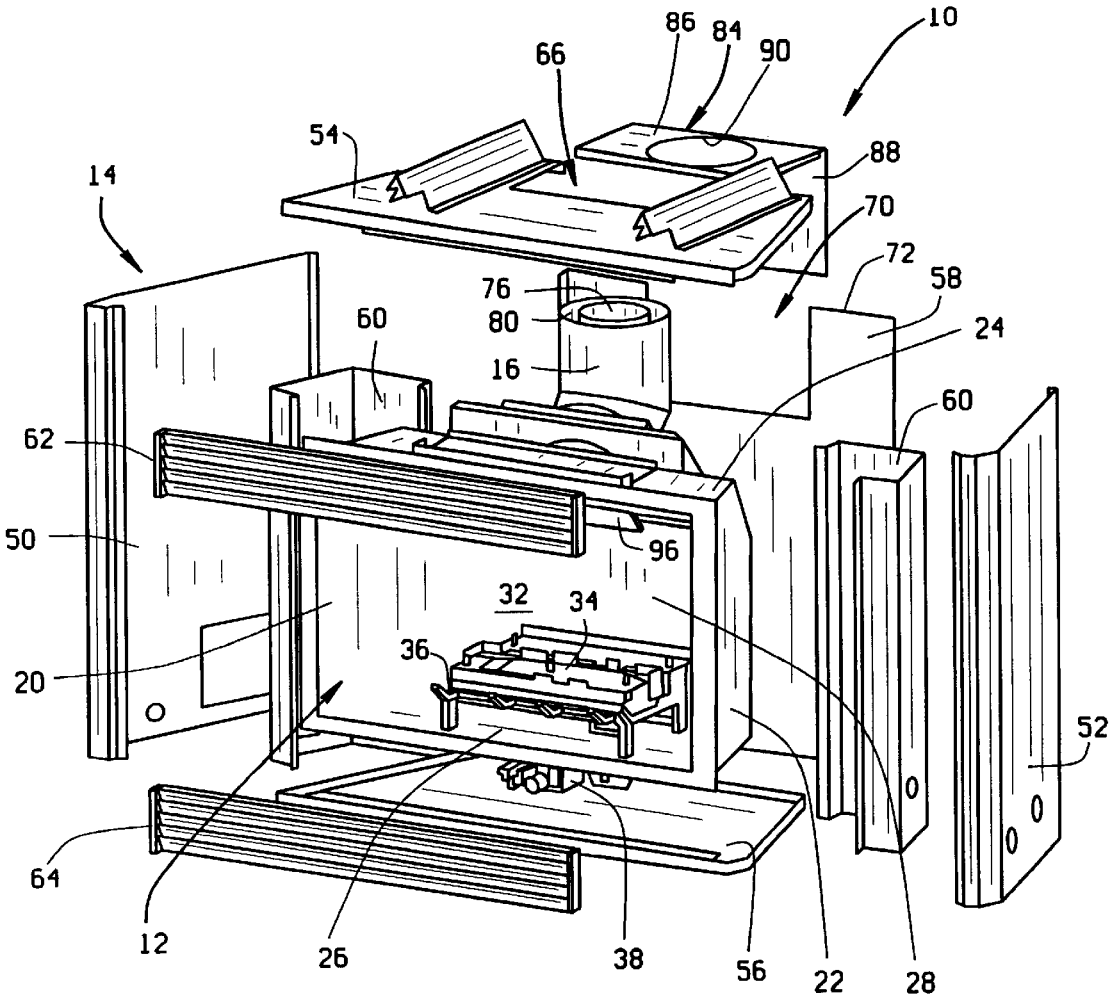
FIG. 1 shows a front, perspective, exploded view of the direct vent gas fireplace of the invention.
Figure 2:
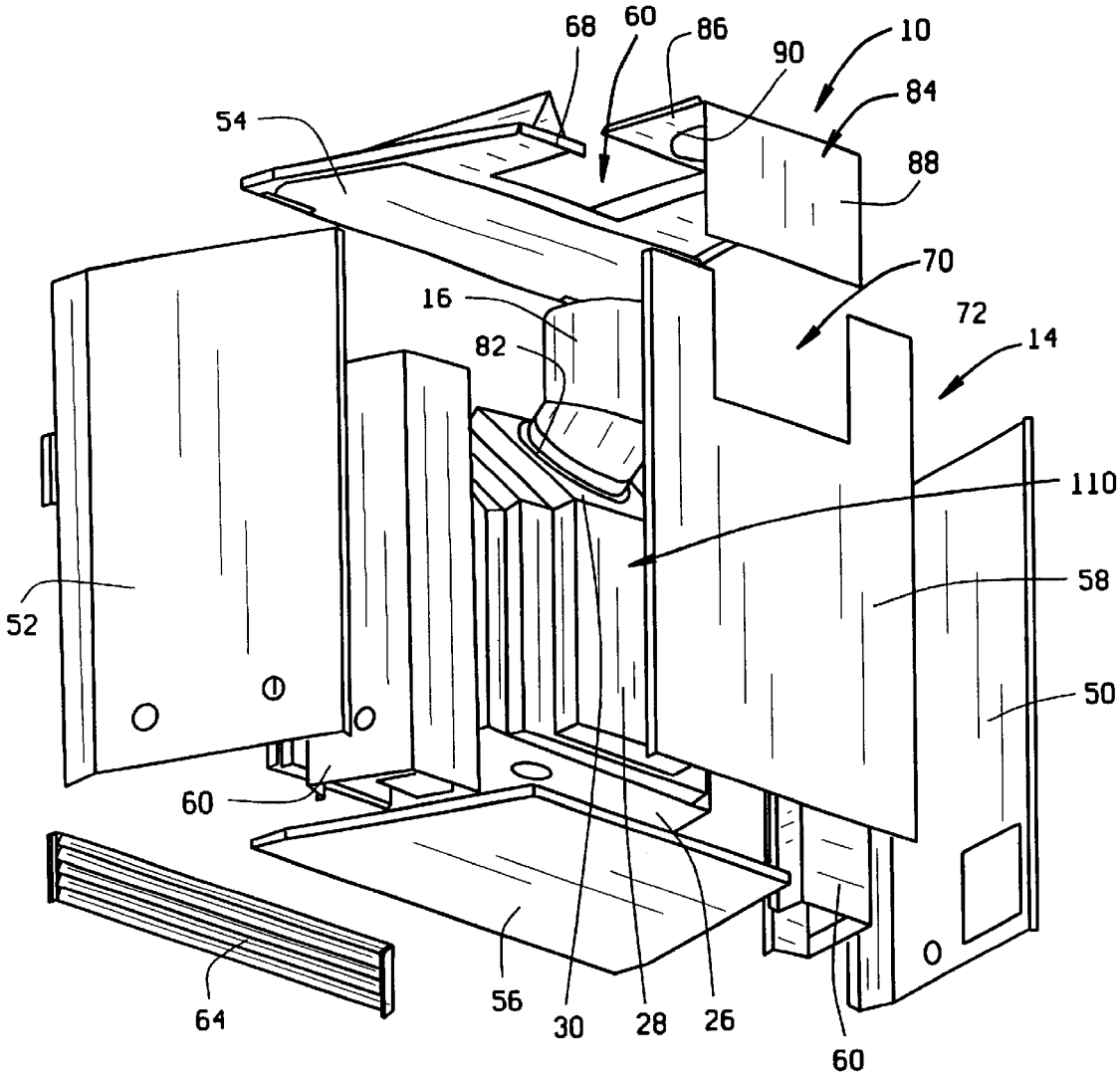
FIG. 2 is a rear perspective view similar to that of FIG. 1.

FIGS. 1 and 2 show respective front and rear exploded views of the basic component parts of the direct vent gas fireplace 10 of the present invention. As stated earlier, the basic construction of the direct vent gas fireplace 10 is similar to that of prior art gas fireplaces in that it includes a firebox 12 supported in and surrounded by an outer shell 14 and an angled flue pipe 16 that enables the outlet end of the flue pipe to be directed either vertically or horizontally. However, the gas fireplace of the invention includes novel structural features that improve its efficiency in transferring heat of combustion to ambient room air cycled through the fireplace and also provide the fireplace with a self-contained, supporting structure for the angled flue pipe 16 that contains a majority of the flue pipe within the outer shell 14.

The fireplace is basically constructed from formed sheet metal parts that are connected together by sheet metal screws, rivets, spot welds, crimping or other equivalent means of connection.

Figure 3:
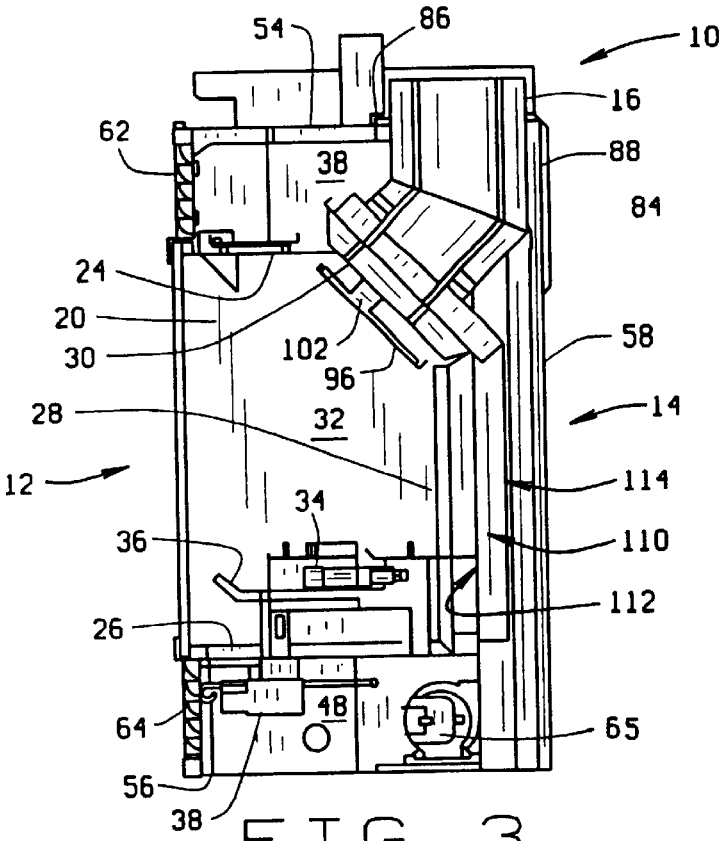
FIG. 3 is a right side, sectioned view of the fireplace of the invention.

The firebox 12 is comprised of opposite left 20 and right 22 side panels, opposite top 24 and bottom 26 panels, a vertical back panel 28 and an angled back panel 30. All of these panels are connected together as shown in FIGS. 1 and 2 with the angled back panel 30 extending from the top of the vertical back panel 28 to the rear edge of the top panel 24. The panels all surround a heat chamber 32 of the firebox that is accessible through a front opening of the fireplace. The heat chamber 32 contains the gas burner 34 as well as the decorative grate 36 and the gas logs (not shown) that cover the gas burner. A conventional-gas supply control assembly 38 that controls the supply of gas to the burner 34 is secured to the underside of the firebox bottom panel 26 as shown in FIG. 3. An exhaust opening 40 that exhausts combustion fumes from the heat chamber 32 passes through the angled back panel 30 and is centered relative to the firebox. A pair of air inlet openings 42 pass through the vertical back panel 28 of the firebox adjacent the bottom panel 26 and are centered horizontally relative to the exhaust opening 40.

The outer shell 14 encloses the firebox 12 and supports the firebox in the outer shell in a suspended manner that creates a heat exchange volume 48 between the exterior of the firebox and the interior of the outer shell. The outer shell includes opposite left 50 and right 52 side walls, opposite top 54 and bottom 56 walls and a rear wall 58. The walls are connected together surrounding the firebox 12. A pair of bent uprights 60 are also enclosed in the outer shell 14 and are connected between the firebox 12 and the outer shell side walls 50, 52 and top 54 and bottom 56 walls. The uprights 60 support and firebox 12 in its suspended position inside the shell 14 with the heat exchange volume 48 enclosed in the shell surrounding all of the panels of the firebox. Top 62 and bottom 64 vent panels extend between the outer shell side walls 50, 52 above and below the access opening of the firebox 12. An electrically operated blower 66 is contained in the shell 14 and is selectively activated to draw in ambient room air through the bottom vent panel 64 and cycle the room air through the heat exchange volume 48 around the firebox 12 before forcing the heated air out through the top vent panel 62.

The constructions of the firebox 12 and the shell 14 described to this point are, for the most part, conventional. However, the shell 14 of the fireplace is able to enclose a majority of an angled, directional flue pipe as will be explained. In order to receive the angled, directional flue pipe the top wall 54 is provided with a rectangular opening 66 centered along its back edge 68 and the rear wall 58 is also provided with a rectangular opening 70 centered along its top edge 72. The two openings 66, 70 have the same dimensions. The rear edge 68 of the top wall and the top edge 72 of the rear wall are connected together at a right angle with the two rectangular openings 66, 70 intersecting each other and being centered relative to the edges 68,72 of the top wall and rear wall. The two openings 66, 70 provide sufficient clearance for the angled flue pipe of the fireplace whether the flue pipe extends vertically or horizontally.

The flue pipe 16 is an angled flue pipe constructed similar to those of the prior art. The flue pipe includes a center exhaust pipe 76 and a concentric air pipe 80 that surrounds the exhaust pipe. Both the exhaust pipe 76 and the air pipe 80 have the same angled configuration. A proximal end 82 of the exhaust pipe is secured to the angled back panel 30 of the firebox and communicates with the exhaust opening 40. The flue pipe 16 can be connected to the firebox 12 in two positions of the flue pipe relative to the firebox. In a first position of the flue pipe shown in FIG. 6, the exhaust pipe 76 and the air pipe 80 extend vertically upward through the rectangular opening 66 in the shell top wall 54. In the second position of the flue pipe shown in FIG. 7, both the exhaust pipe 76 and the air pipe 80 extend horizontally through the rectangular opening 70 in the rear wall 58 of the outer shell. In both positions of the flue pipe connected to the firebox 12 the flue pipe is primarily contained inside the outer shell 14.

The novel construction of the gas fireplace of the invention includes a flue pipe plate 84 that closes the shell top wall opening 66 and the shell rear wall opening 70 and also provides support to the flue pipe 16 in both positions of the flue pipe relative to the firebox. The flue pipe plate 84 is comprised of two rectangular sections 86, 88 that are bent at a right angle relative to each other. The two sections 86, 88 of the pipe plate are dimensioned-to close either the outer shell top wall opening 66 or the outer shell rear wall opening 70 when the plate is secured to the outer shell. Only one 86 of the two sections of the flue pipe plate has an opening 90 therethrough. The opening 90 is dimensioned to receive the flue pipe 16 in a snug fit. The pipe plate 84 can be attached to the outer shell 14 in two positions of the plate relative to the shell. In the first position of the pipe plate 84 shown in FIG. 6, the plate section 86 with the flue opening 90 is attached to the shell top wall 54 and the other plate section 88 closes the opening 70 in the shell rear wall 58. The pipe plate 84 is attached to the outer shell 14 in this first position when the angled flue pipe 16 is attached to the firebox 12 with the distal end 92 of the flue pipe projecting vertically upward from the firebox through the pipe plate opening 90. In the second position of the pipe plate 84 shown in FIG. 7, the plate section 86 with the flue opening 90 is attached to the outer shell rear wall 58 and the other plate section 88 closes the opening 66 in the outer shell top wall 54. This positioning of the pipe plate 84 is used when the angled flue pipe 16 is attached to the firebox 12 with the flue pipe distal end 92 projecting horizontally from the firebox 14. In either of the two positions of the pipe plate 84 mounted on the outer shell 14, the plate opening 90 surrounds the flue distal end 92 that projects from the outer shell 14 and provides support to the flue pipe. In addition, the outer shell 14 together with the flue pipe plate 84 contain the angled portion of the flue pipe 16 within the outer shell.

Figure 4:
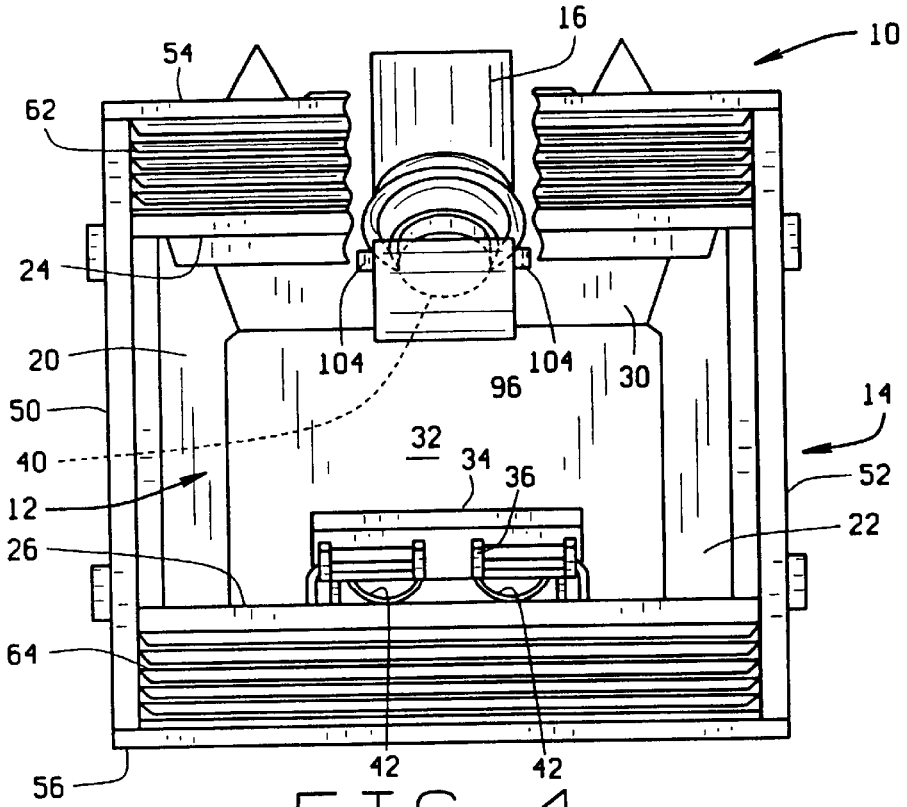
FIG. 4 is a front elevation view of the fireplace.
Figure 5:
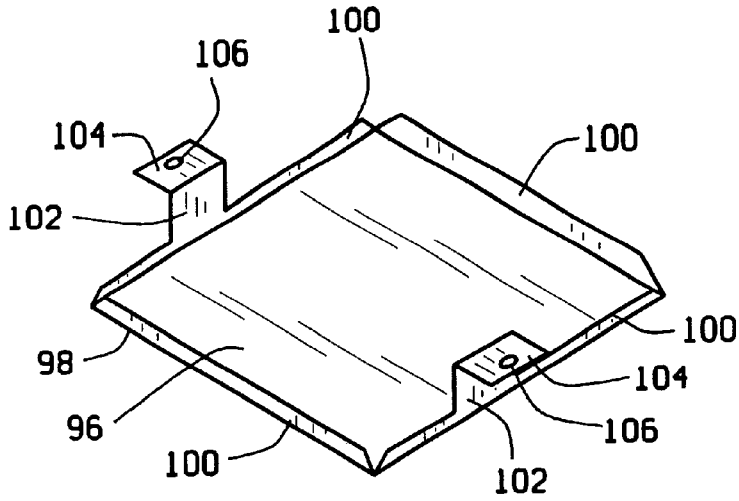
FIG. 5 is a perspective view of the baffle removed from the fireplace.

The novel construction of the fireplace also includes a baffle 96 in the fireplace heat chamber 32 that conceals the exhaust opening 40 from view without appreciably shielding the interior panels of the firebox from the heat of combustion generated in the heat chamber. The baffle 96 has a simple and inexpensive, one-piece construction as shown in FIG. 5. The baffle 96 is formed of sheet metal with a rectangular, and preferably square, perimeter edge 98. The perimeter edge 98 is formed by bent flanges 100 that reinforce the baffle. The baffle is also formed with a pair of spacer arms 102 that project at a right angle from the baffle. The spacer arms 102 have bent tabs 104 at their ends and fastener holes 106 pass through the tabs. The baffle 96 is dimensioned just large enough so that its perimeter edge 98 will extend around the firebox exhaust opening 40 and thereby conceal the opening from view through the access opening of the firebox. As see in FIG. 4, the spacer arms 102 are positioned on opposite sides of the exhaust opening 40 and the arm tabs 104 are secured to the angled back panel 30 of the firebox by threaded fasteners (not shown). As seen in FIG. 3, the baffle 96 is positioned by the spacer arms 102 in a plane that is spaced in front of the plane of the exhaust opening 40 and is also parallel to the plane of the exhaust opening. In this manner, the baffle 96 aesthetically conceals the exhaust opening 40 from view but does not appreciably shield the interior surface of the firebox panels, and in particular the angled back panel 30, from the heat of combustion in the heat chamber 32. Although the preferred embodiment of the baffle 96 is constructed in a generally flat configuration, other configurations could also be employed, for example a conical configuration with a perimeter edge at the base of the cone spaced in front of the exhaust opening of the firebox.

Figure 8:
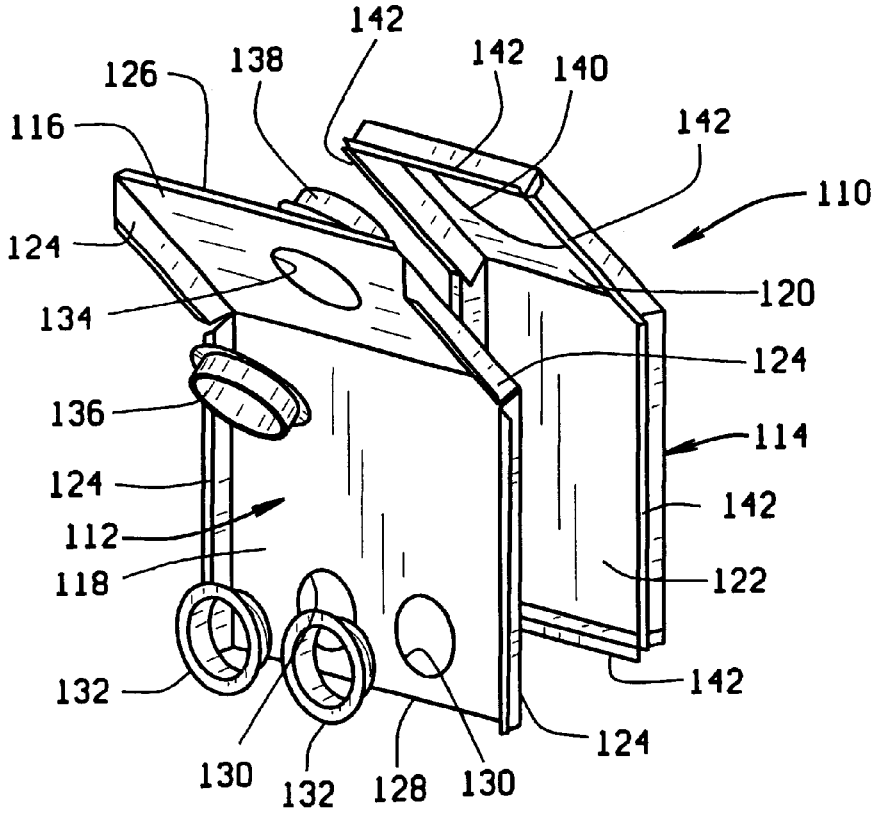
FIG. 8 is an exploded, perspective view of the air column disassembled from the fireplace.
Figure 6:
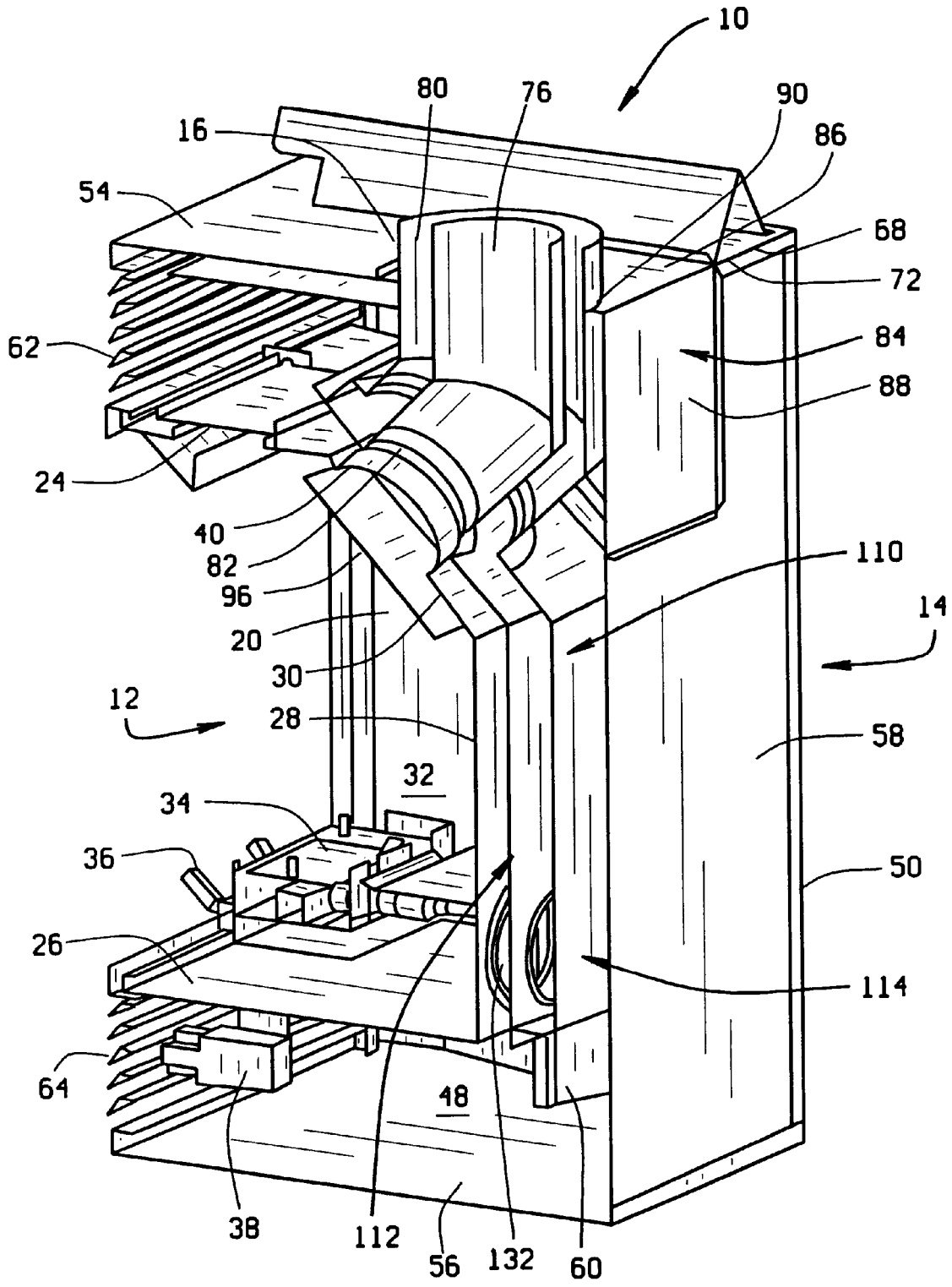
FIG. 6 is a right side, sectioned perspective view of the fireplace with the flue pipe projecting vertically.
Figure 7:
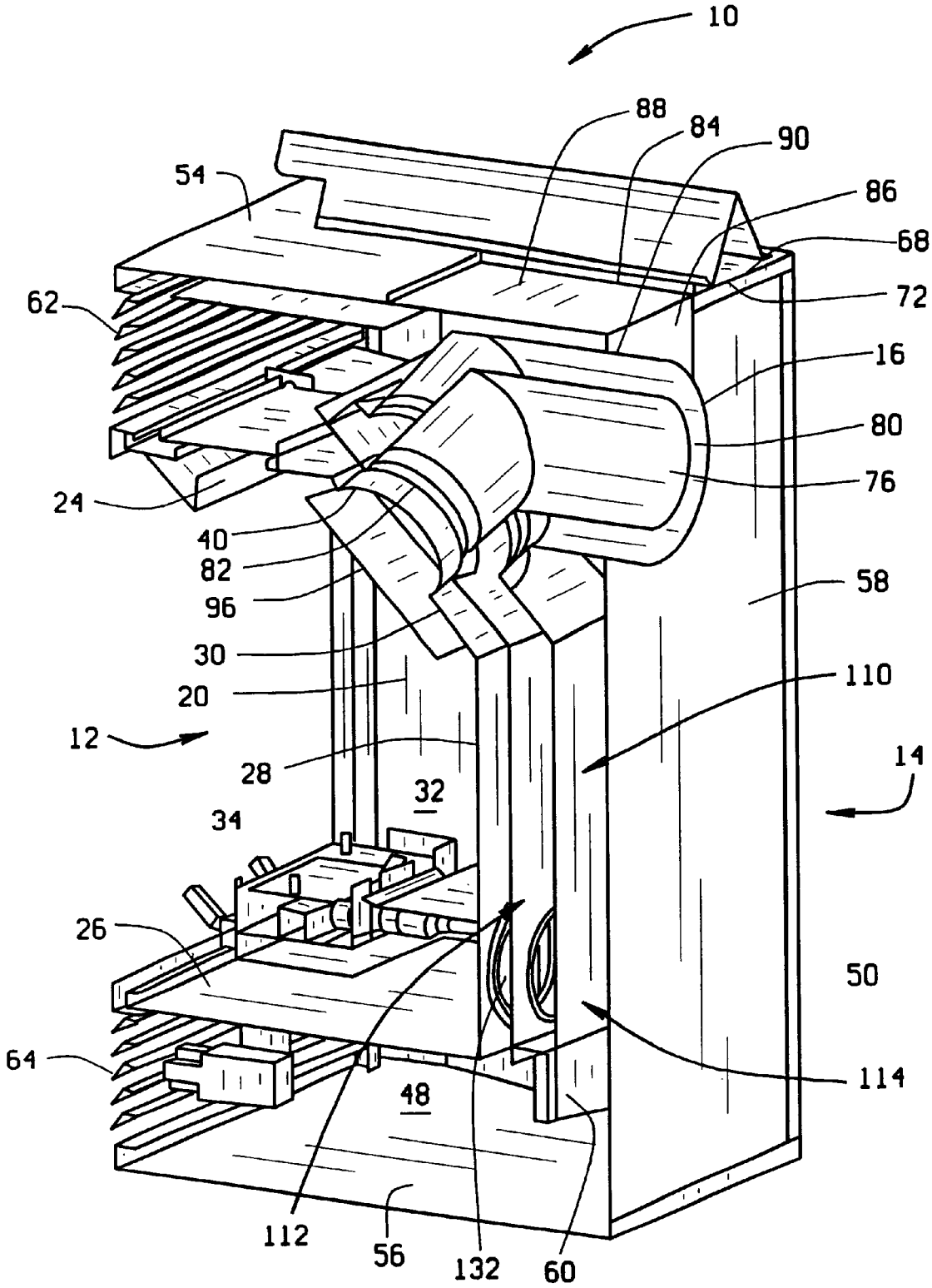
FIG. 7 is a view similar to that of FIG. 6 with the flue pipe adjusted to project horizontally.

The gas fireplace of the invention is also provided with an air vent column 110 that communicates with the vent air pipe 80 of the flue and provides a direct path from the vent air pipe to the air vent openings 42 of the firebox. The air column 110 is shown disassembled from the fireplace in FIG. 8. The air column is constructed from a front panel 112 and a rear panel 114. The front panel 112 has top 116 and bottom 118 sections that are bent at an angle relative to each other. The angle between these sections corresponds to the angle between the firebox angled back panel 30 and vertical back panel 28. The air column rear panel 114 also has a top section 120 and a bottom section 122 that are bent at the same angle as the air column front panel 112. The front panel 112 is provided with bent flanges 124 along its opposite sides, but does not have flanges at its top edge 126 or its bottom edge 128. The side flanges 124 of the front panel secure the panel to the backs of the firebox vertical back panel 128 and angled back panel 30 providing a spacing between these firebox panels and the air column panel. The spacing allows air circulated through the heat exchange volume of the fireplace to pass between the back of the firebox and the front of the air column. The air column front panel 112 also has a pair of air vent openings 130 adjacent its bottom edge. A pair of flanged, annular collars 132 are connected around the air vent openings 130 of the air column front panel 112 and are also connected to the firebox vertical back panel 28 around the air vent openings 42 of the back panel. An exhaust opening 134 is provided through the top section 116 of the front panel. Another flanged, annular collar 136 is secured to the front panel top section 116 around the exhaust opening and is also secured to the firebox angled back panel 30 around the exhaust opening 40 of the firebox. A still further flanged, annular collar 138 is secured to the front panel top section 116 around the exhaust opening 134. The air column rear panel 114 has an opening 140 through its top section 120 that is larger than and surrounds this last mentioned flanged, annular collar 138. The rear panel 114 is also provided with bent flanges 142 around its entire perimeter. These bent flanges 142 secure the rear panel 114 in a spaced relation to the front panel 112. The connections of the front and rear panels 112, 114 create a vent air flow path through the larger opening 140, down through the air column 110 formed by the two panels 112, 114 and out through the pair of air vent openings 130. As seen in FIGS. 6 and 7, the flue air pipe 80 is connected to the larger air column opening 140 and the flue exhaust pipe 82 is connected to the flanged, annular collar 138 in the air column. Thus, vent air that passes through the flue air pipe 80 enters the air column through the larger air opening 140, then moves downwardly through the air column to the pair of air vent openings 30 that direct the air into the firebox 12 adjacent the firebox bottom panel 126. The air column 110 is connected to the back of the firebox 12 in a spaced relation and is also spaced from the rear wall 58 of the outer shell. The air column 110 is also centered relative to the firebox exhaust opening 40. By constructing the air column in this manner, so that it channels vent air along its shortest path to the vent air inlets of the firebox, the air column does not appreciably obstruct the flow of ambient room air cycled through the heat exchange volume and around the firebox and the air column provides a direct path of vent air passing through the air pipe of the flue to the vent air inlets of the firebox which minimizes any transfer of heat from ambient room air circulated through the heat exchange volume to the cooler vent air passing through the air column.

The direct vent gas fireplace of the invention constructed as described above provides the benefits of positioning the angled flue pipe of the fireplace within the fireplace outer shell, thereby eliminating the need for any additional structure outside the fireplace to accommodate and support the angled flue pipe, concealing the exhaust opening in the firebox from view through the firebox access opening without appreciably shielding the interior surfaces of the firebox panels from the heat of combustion in the heat chamber, and providing vent air to the heat chamber of the firebox without appreciably obstructing or cooling the flow of ambient air through the heat exchange volume of the fireplace. while the present invention has been described by reference to specific embodiment, it should be understood that modifications and variations of the invention may be constructed without departing from the scope of the invention defined in the following claims.

What is claimed:

1. A fireplace comprising:

a firebox having a plurality of panels surrounding a heat chamber of the firebox, the firebox having a front opening providing access to the heat chamber;

an outer shell surrounding the plurality of firebox panels and enclosing a heat exchange volume between the firebox and the outer shell;

a flue pipe having first and second sections connected at an angle to each other, the flue pipe first section is connectable to the firebox in first and second positions of the flue pipe first section relative to the firebox, where in the first position of the flue pipe first section the flue pipe second section is oriented vertically and in the second position of the flue pipe first section the flue pipe second section is oriented horizontally;

a flue pipe plate connected to the outer shell, the flue pipe plate has an opening therethrough and the flue pipe passes through the flue pipe plate opening when the flue pipe first section is connected to the firebox in the first position of the flue pipe first section and in the second position of the flue pipe first section;

the outer shell has a top wall and a rear wall that are connected together at an angle along a top, rear edge of the outer shell;

the flue pipe plate has two plate sections that are oriented at an angle to each other and the opening passes through only one of the two plate sections; and, the flue pipe plate is connectable to the outer shell in first and second positions of the flue pipe plate relative to the outer shell, where in the first position of the flue pipe plate the one section with the opening is connected to the outer shell top wall and in the second position of the flue pipe plate the one section with the opening is connected to the outer shell rear wall.

2. The fireplace of claim 1, wherein:

the connection of the flue pipe first section to the flue pipe second section is positioned in the heat exchange volume between the firebox and the outer shell.

3. The fireplace of claim 1, further comprising:

flue pipe second section passes through the flue pipe plate opening when the flue pipe first section is connected to the firebox in the first position of the flue pipe first section and in the second position of the flue pipe first section.

4. The fireplace of claim 1, further comprising:

the two plate sections of the flue pipe plate are oriented at a right angle relative to each other.

5. The fireplace of claim 1, further comprising:

the flue pipe having an air pipe and an exhaust pipe that are concentric to each other and both pass through the first and second sections of the flue pipe and the opening of the flue pipe plate.

6. The fireplace of claim 1, further comprising:

the opening in the flue pipe plate being positioned in a horizontal plane when the flue pipe plate is in the first position and the opening in the flue pipe plate being positioned in a vertical plane when the flue pipe plate is in the second position.

7. The fireplace of claim 1, further comprising:

the firebox having an exhaust opening positioned on the firebox where combustion fumes in the heat chamber will exit the heat chamber through the exhaust opening; and, a baffle connected to the firebox in the heat chamber, the baffle having a perimeter edge that surrounds the exhaust opening and is spaced in front of the exhaust opening.

8. The fireplace of claim 7, further comprising:

the baffle perimeter edge not being connected to the firebox.

9. The fireplace of claim 1, wherein:

the baffle having at least one spacer that projects from the baffle and is connected to the firebox spacing the baffle perimeter edge from the firebox and the exhaust opening.

10. The fireplace of claim 9, further comprising:

the baffle and the at least one spacer being one monolithic piece.

* * * * *